US008016403B2

(12) United States Patent
Jones et al.

(10) Patent No.: US 8,016,403 B2
(45) Date of Patent: Sep. 13, 2011

(54) SOLID INK STICK WITH VISUAL ORIENTATION INDICATOR

(75) Inventors: Brent Rodney Jones, Sherwood, OR (US); Frederick T. Mattern, Portland, OR (US); Christopher Ryan Gold, Tigard, OR (US); Brian Walter Aznoe, Sherwood, OR (US); William Loren Emery, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 772 days.

(21) Appl. No.: 11/906,667

(22) Filed: Oct. 3, 2007

(65) Prior Publication Data

US 2009/0091609 A1 Apr. 9, 2009

(51) Int. Cl.
*B41J 2/175* (2006.01)

(52) U.S. Cl. ..... 347/88; 347/99

(58) Field of Classification Search ..... 347/84, 347/85, 88, 95, 99
See application file for complete search history.

(56) References Cited

U.S. PATENT DOCUMENTS

| | | | | |
|---|---|---|---|---|
| 5,135,165 | A * | 8/1992 | Greenhow | 238/341 |
| 5,356,231 | A * | 10/1994 | Nakamura et al. | 400/636 |
| 6,719,413 | B2 * | 4/2004 | Jones | 347/84 |
| 6,755,517 | B2 | 6/2004 | Jones et al. | |
| 6,857,732 | B2 | 2/2005 | Jones et al. | |
| 6,874,880 | B2 | 4/2005 | Jones | |
| 6,986,570 | B2 * | 1/2006 | Jones et al. | 347/88 |
| D521,065 | S * | 5/2006 | Jones et al. | D18/56 |
| 7,108,363 | B2 * | 9/2006 | Jones et al. | 347/88 |
| D586,387 | S * | 2/2009 | Aznoe et al. | D18/56 |
| 7,753,511 | B2 * | 7/2010 | Jones et al. | 347/88 |
| 2006/0279617 | A1 * | 12/2006 | Korn et al. | 347/88 |
| 2008/0266342 | A1 * | 10/2008 | Steinfield et al. | 347/14 |

FOREIGN PATENT DOCUMENTS

| | | | |
|---|---|---|---|
| EP | 1359023 | A1 | 11/2003 |
| EP | 1359024 | A1 | 11/2003 |
| EP | 1431042 | A1 | 6/2004 |
| EP | 1970200 | A2 | 9/2008 |

OTHER PUBLICATIONS

EP Search Report, European Patent Office, Feb. 12, 2009, 7 pages.

* cited by examiner

*Primary Examiner* — Ellen Kim
(74) *Attorney, Agent, or Firm* — Maginot, Moore & Beck LLP

(57) ABSTRACT

An ink stick for use in a phase change ink imaging device comprises an ink stick body configured for insertion in an insertion orientation into an ink loader of the phase change ink imaging device. The ink stick body has a plurality of surfaces. A visual orientation indicator is formed on at least one surface in the plurality of surfaces. The visual orientation indicator is configured to visually indicate a direction of orientation of at least one surface of the plurality of surfaces to place the ink stick body in the insertion orientation.

19 Claims, 5 Drawing Sheets

SOLID INK STICK WITH VISUAL ORIENTATION INDICATOR

TECHNICAL FIELD

This disclosure relates generally to phase change ink jet printers and the solid ink sticks used in such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

The correct loading and feeding of ink sticks has typically been accomplished by incorporating loading features, such as, for example, keying, guiding, alignment, orientation and/or sensor actuating features, into the exterior surface of an ink stick. These features are protuberances or indentations that are located in different positions on an ink stick. Corresponding keys or guide elements on the perimeters of the openings through which the ink sticks are inserted or fed exclude ink sticks which do not have the appropriate perimeter key elements while ensuring that the ink stick is properly aligned and oriented in the feed channel. Another method that has been implemented to aid in the correctly loading of an ink stick is the incorporation of encoding features into the exterior surface of ink sticks that interact with sensors in the ink delivery system. Ink stick data may be encoded into these features by configuring the features to interact with one or more sensors in an ink loader to generate a signal or coded pattern of signals that corresponds to information specific to the ink stick. The ink stick data encoded onto the ink stick may be read by the print controller in a suitably equipped phase change ink jet printing device to control imaging operations. For example, the controller may enable or disable operations, optimize operations or influence or set operation parameters based on the ink stick data encoded onto the ink stick.

Customers, however, may not be familiar with the loading features of the various ink stick configurations. Consequently, customers may not know the appropriate orientation for inserting an ink stick into an ink loader. A customer believing that they have correctly oriented an ink stick for insertion may override resistance caused by insertion keying features and inadvertently force an incorrectly oriented ink stick through an opening into a feed channel. If the loaded ink stick is the wrong color for a particular feed channel or if the ink stick is incompatible with the phase change ink jet printer in which it is being used, considerable errors and malfunctions may occur. Even if an ink stick is the correct configuration for use in a particular feed channel, an ink stick that is not oriented correctly prior to insertion may not feed properly along the feed channel and/or may not engage the ink melter appropriately. In addition, encoding features on an ink stick that has been inserted incorrectly may not be positioned optimally in the feed channel to interact with sensors resulting in faulty actuation of the sensors or no actuation at all. Nesting features have been incorporated in ink sticks to benefit feed control, differentiate between models and other benefits but such features have never been configured to serve as obvious orientation aids.

SUMMARY

An ink stick for use in a phase change ink imaging device has been developed that includes a feature for visually indicating to a printer user the correct insertion orientation for the ink stick. The ink stick comprises an ink stick body configured for insertion in an insertion orientation into an ink loader of the phase change ink imaging device. The ink stick body has a plurality of surfaces. A visual orientation indicator is formed on at least one surface in the plurality of surfaces. The visual orientation indicator is configured to visually indicate a direction of orientation of at least one surface of the plurality of surfaces to place the ink stick body in the insertion orientation.

In another embodiment, a system of visually indicating appropriate ink stick orientation is utilized. The system comprises a solid ink stick configured for insertion in an insertion orientation into an ink loader of a phase change ink imaging device. The solid ink stick includes a visual orientation indicator incorporated into one or more surfaces of the ink stick. The visual orientation indicator comprises a mark for visually indicating the insertion orientation of the ink stick. The system also includes a complementary orientation indicator positioned on one or more surfaces of the imaging device. The complementary orientation indicator comprises a mark for visually indicating the insertion orientation.

In yet another embodiment, an ink stick for use in an ink loader of a phase change ink imaging device comprises an ink stick body adapted to be received through an insertion opening of an ink loader of a phase change ink imaging device in an insertion orientation. The ink stick body includes a leading end and a trailing end. The leading end is for orienting substantially in a feed direction of the ink loader when in the insertion orientation, and the trailing end is for orienting opposite the feed direction when in the insertion orientation. A visual orientation indicator is formed on at least one surface of the ink stick body. The visual orientation indicator being configured to visually indicate a direction of orientation of the leading and trailing ends of the ink stick body to place the ink stick body in the insertion orientation.

DETAILED DESCRIPTION OF THE PREFERRED EMBODIMENT

Figure 1:
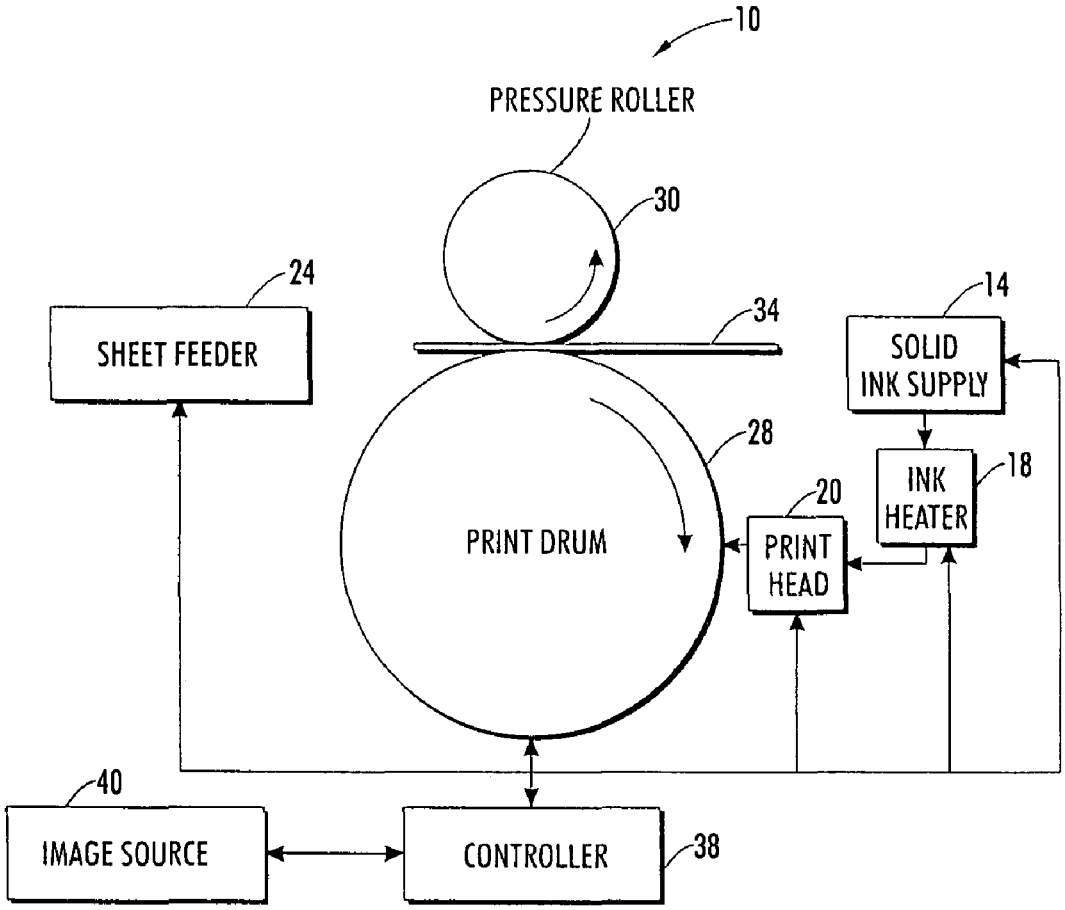
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling many or all of the other machine subsystems and functions, including the machine's printing operations, and, thus, includes the necessary hardware, software, etc. for controlling these various systems.

Figure 2:
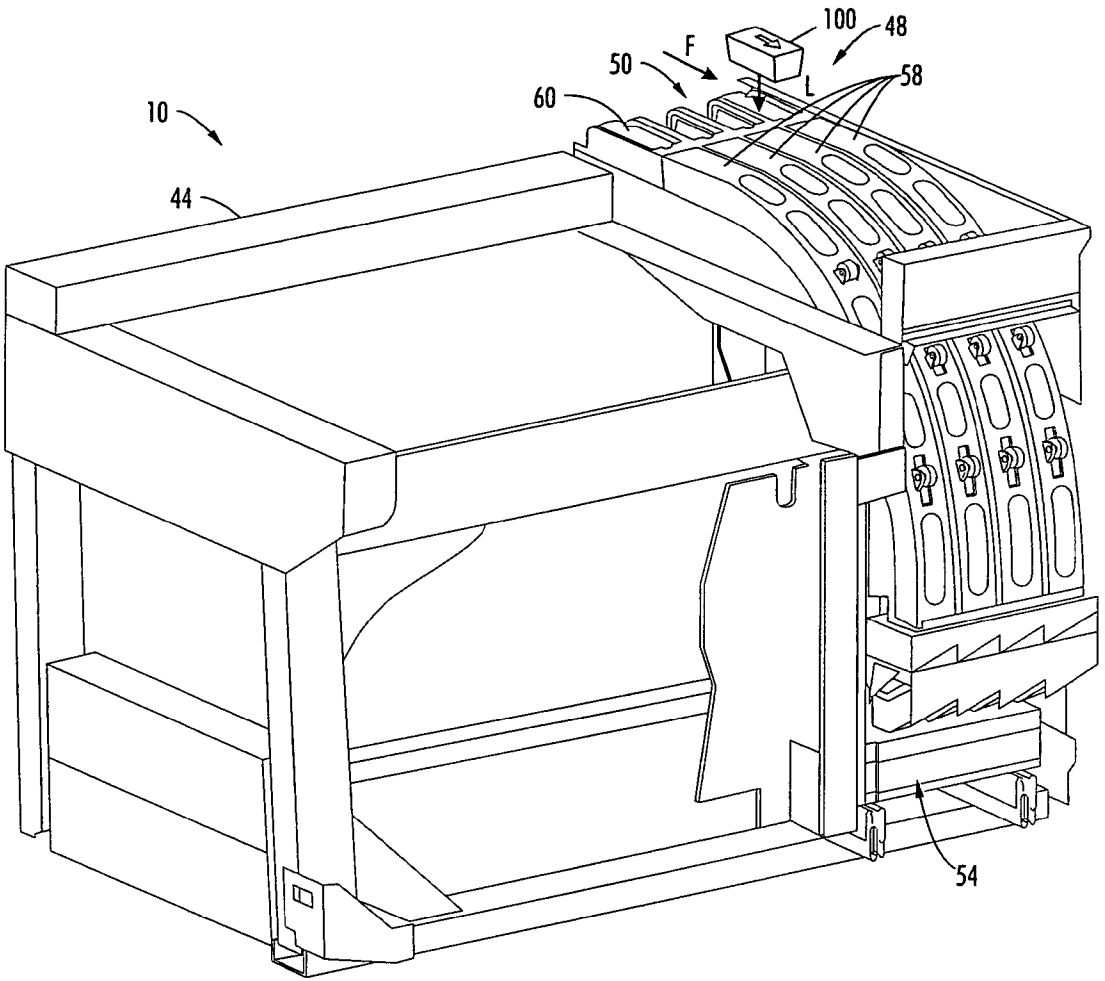
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L, F are different. For example, ink sticks may be inserted in the insertion direction L and then moved along the feed channel in the feed direction F. In an alternative embodiment, the feed channels and keyed openings may be oriented such that the insertion and feed directions L, F are substantially parallel.

Figure 3:
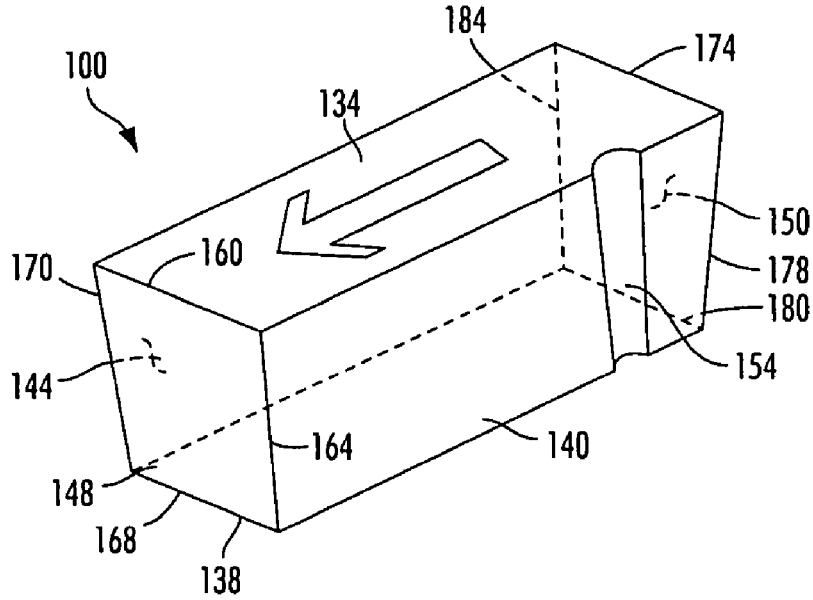
FIG. 3 is a perspective view of one embodiment of a solid ink stick with an embossed visual orientation indicator.

An ink stick may take many forms. One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Figure 4:
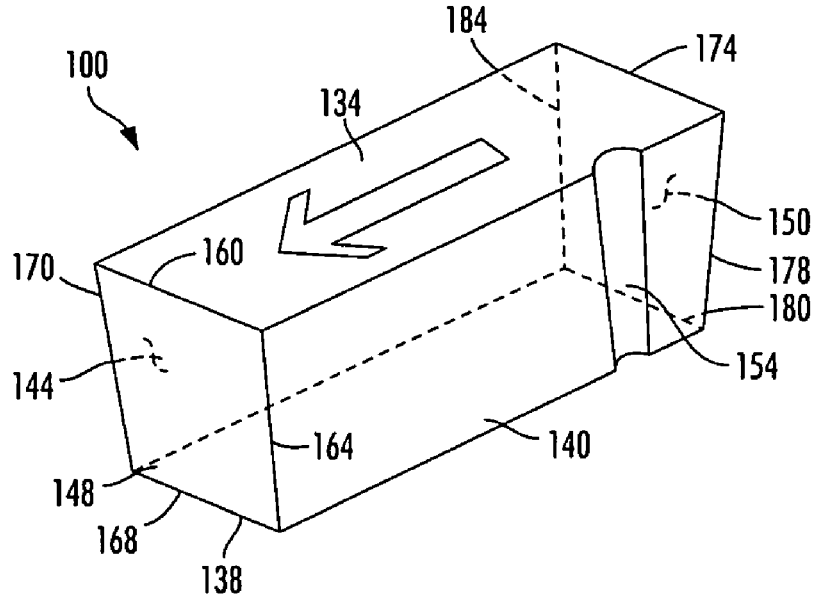
FIG. 4 is a perspective view of one embodiment of a solid ink stick with a debossed visual orientation indicator.

Ink sticks may include a number of features that aid in correct loading, guidance, sensing and support of the ink stick when used. These features may comprise protrusions and/or indentations that are located in different positions on an ink stick for interacting with key elements, guides, supports, sensors, etc. located in complementary positions in the ink loader. For example, as shown in FIG. 4, the ink stick may include one or more insertion keying features 154. The stick keying features interact with the keyed openings 60 of the loading station 50 to admit or block insertion of the ink sticks through the insertion opening 60 of the solid ink delivery system. In the ink stick embodiment of FIG. 3, the key element 154 is a vertical recess or notch formed in side surface 140 of the ink stick body. The corresponding complementary key (not shown) on the perimeter of the keyed opening 60 is a complementary protrusion into the opening 60. Any number or shape of key features may employed in any suitable position on the ink stick.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key and/or sensing feature arrangement for ink sticks of each color.

Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers.

While the insertion keying features describe above may aid in ensuring that an ink stick is inserted with the proper insertion orientation, these features are primarily exclusionary in that the insertion keying features act to exclude ink sticks from being inserted that are not oriented correctly. Because customers may not be familiar with the loading features of the various ink stick configurations, customers may not know the appropriate orientation for inserting an ink stick into an ink loader. A customer believing that they have correctly oriented an ink stick for insertion may override resistance caused by insertion keying features and inadvertently force an incorrectly oriented ink stick through an opening into a feed channel.

Figure 5:
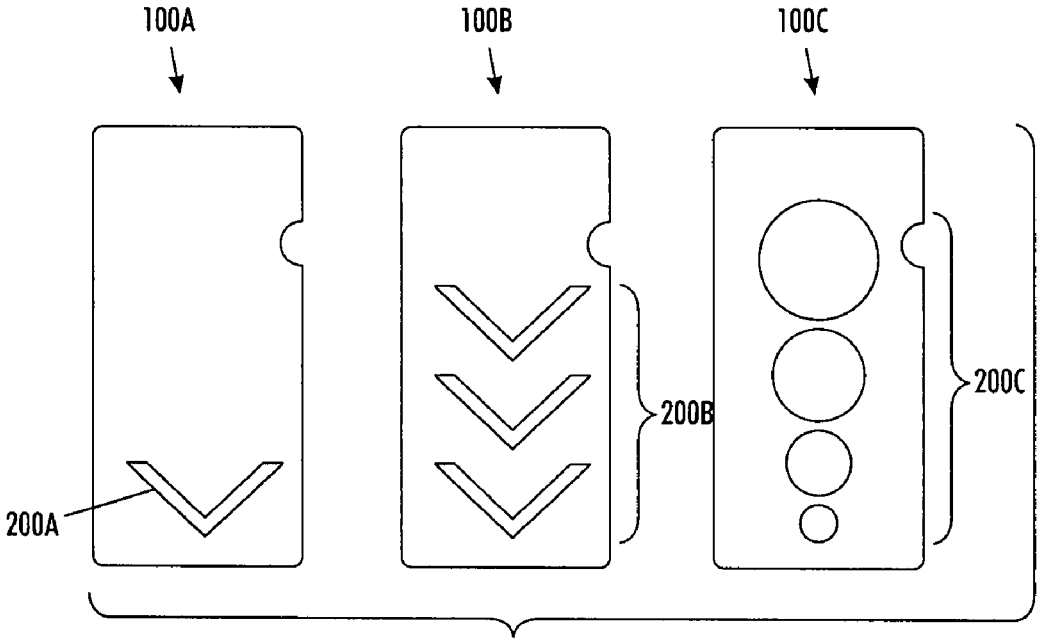
FIG. 5 shows three ink sticks with alternative embodiments of visual orientation indicators.

To further aid in the correct loading of ink sticks into the ink delivery system, the ink stick may include a visual orientation indicator 200 as shown in FIGS. 3 and 4. A visual orientation indicator 200 comprises a visually identifiable mark for indicating to a printer user the correct orientation of the ink stick for insertion. In the embodiment of FIGS. 3 and 4, the visual orientation indicator comprises an arrow-shaped feature formed in the top surface of the ink stick body. The arrow-shaped feature is formed such that the arrow points in a direction from the trailing end of the ink stick toward the leading end. Accordingly, in this embodiment, the arrow is configured to indicate to a printer user in which direction the leading end of the ink stick is to oriented prior to insertion through a keyed opening of the ink delivery system. In the ink delivery system of the printer of FIG. 1, the leading end of the ink stick is intended to be oriented along the feed direction of the ink delivery system for insertion. Thus, in one embodiment, the visual orientation indicator may comprise a visual feed direction indicator. A printer user may place an ink stick in the insertion orientation by aligning the arrow-shaped feature on the ink stick with the feed direction of the ink loader prior to inserting the ink stick through the insertion opening. Although the orientation indicator 200 of FIGS. 3 and 4 comprise arrows, other symbols that may convey orientation information to a printer user may be used. For example, FIG. 5 shows ink sticks 100A-C with alternative embodiments of visual orientation indicators 200A-C. Similar to the arrow configuration of FIGS. 3 and 4, the indicators 200A-C of FIG. 5 are configured to convey the direction of orientation of the ink stick.

In the embodiments of FIGS. 3 and 4, the indicator 200 extends over a significant portion of the top surface of the ink stick to enhance the visibility of the indicator to a user. The indicator 200 may have any suitable size so long as it may be easily seen and recognized by a printer user. The visual orientation indicator 200 may be formed on one or more the surfaces of the ink stick body and more than one indicator may be used. For maximum visibility, the visual orientation indicator is formed on the top surface of the ink stick body. To further enhance visibility, the indicator 200 may be formed with a vertical dimension, so that it is seen as three dimensional to the user. For example, the formed indicator may be protruding or inset from a surface of the ink stick. FIG. 3 depicts an indicator 200 that is raised or embossed on the top surface of the ink stick. The indicator 200 could alternatively be impressed or debossed into the horizontal top surface of the ink stick block, as shown in FIG. 4. As an alternative to embossing or debossing an orientation indicator on a surface of an ink stick, indicators may be stamped, silk-screened, painted, etched, laser marked, or otherwise formed on an ink stick in any suitable manner.

Figure 7:
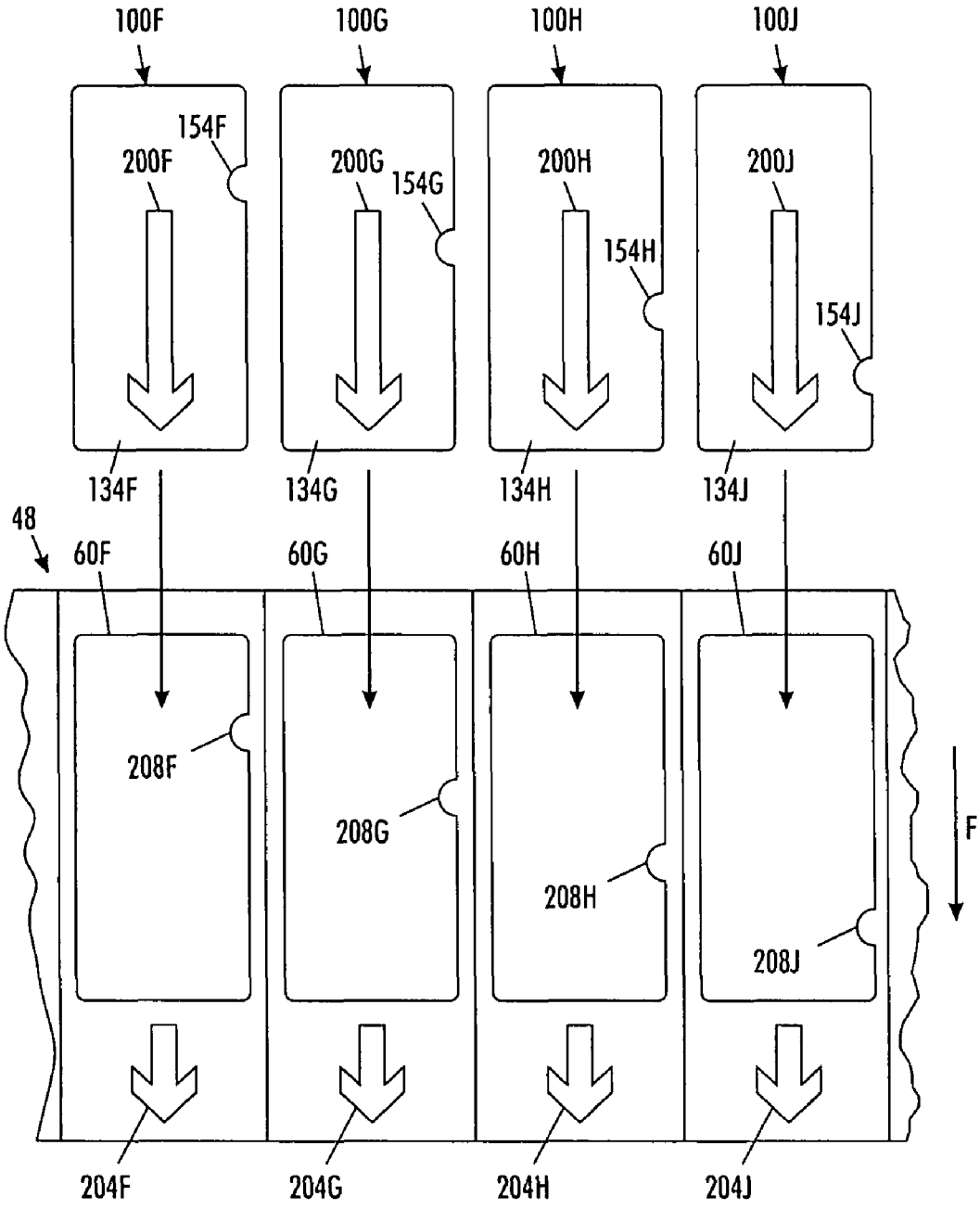
FIG. 7 shows an embodiment of the insertion station of an imaging device that includes complementary orientation indicators.

A system that readily clarifies orientation for a user would include an ink stick with orientation indication as well as illustration information or symbols on the printer, typically on or near the insertion area of a loader. Such illustration may include text and/or symbols and may be on a label or etched, printed, embossed or otherwise made visible on the ink loader or other printer structure or part. For example, FIG. 7 shows an embodiment of an insertion station 48 that includes complementary information for further aiding a user in placing an ink stick in the correct orientation for insertion. In the embodiment of FIG. 7, there is shown four ink stick 100F, 100G, 100H and 100J that are configured for insertion into the insertion openings 60F, 60G, 60H and 60J of the insertion station 48. As can be seen, the ink sticks 100 each include an insertion keying element 154 that is positioned on the ink stick to correspond to the insertion key 208 of the openings 60. The ink sticks include an orientation indicator comprising an arrow formed on the top surface 134 of each ink stick that points substantially in the feed direction F of the loading station 48. To further aid in ensuring the ink sticks 100 have the correct orientation, the insertion station 48 includes complementary orientation indicators 204 positioned adjacent each opening 60. The complementary orientation indicators may be any suitable mark, symbol, etc. that is capable of conveying meaning to a printer operator. While attempting to insert an ink stick, a printer operator may be aided in placing the ink sticks in the insertion orientation by aligning the arrows 200 formed on the top surface 134 of the ink sticks with the arrows positioned adjacent each opening 60.

The visual orientation indicator 200 may be the same for each ink stick in a set. The use of a common orientation indicator along with similarly shaped and sized key elements for the ink sticks of a particular set of ink sticks for a printer facilitates manufacture of the ink sticks, and enhances the "family" appearance of the set of ink sticks for that particular printer. Different visual orientation indicator shapes and/or sizes of indicators may be used to enhance differentiation of ink sticks intended for different models of printers.

Figure 6:
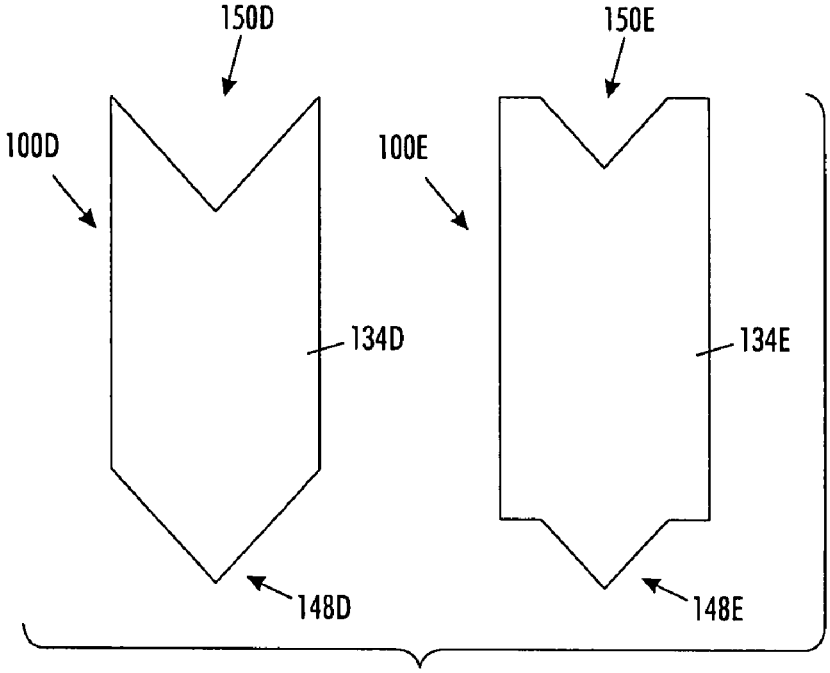
FIG. 6 shows two embodiments of ink sticks in which the shape of the ink stick is the visual orientation indicator.

In another embodiment, a visual orientation indicator may be formed into the ink stick as part of its shape. For example, FIG. 6 show embodiments of ink sticks in which all or a portion of the ink stick body is designed to function as the visual orientation indicator. In this embodiment, the perimeter of the top surface 134 of the ink stick is substantially arrow-shaped with the leading end of the ink stick being pointed so as to be the "head" of the arrow and the trailing end of the ink stick including a complementary shaped indentation so as to be the "tail" of the arrow. Thus, similar to the indicators of FIGS. 3 and 4, a printer user may place an ink stick in the insertion orientation by aligning arrow-shaped ink stick with the feed direction of the ink loader prior to inserting the ink stick through the insertion opening.

The use of stick shape for orientation indication has additional benefits. For example, the leading end and trailing end of the ink sticks of FIG. 6 are substantially complementary shaped. The complementary shapes of the ends of ink sticks facilitate the nesting of adjacent ink sticks in an ink loader. Utilization of the similar angles for the leading and trailing canted surfaces of the ink stick enable adjacent ink sticks to abut, or nest, in a feed channel. Nesting ink sticks in an ink loader has the benefit of maximizing the load density in the ink loader because empty space between ink sticks is minimized. Additionally, abutting ink sticks in the feed channel ensures that the canted extension of the leading ink stick rests on the canted surface of the following stick and is pressed against the melt plate by the following stick thereby preventing the canted extension from falling to the bottom of a feed channel when the base portion of the ink stick has melted. Nesting ink sticks may also limit the movement of one ink stick with respect to adjacent ink sticks thereby reducing the chance that ink sticks will become skewed with respect to each other or with respect to the feed channel as they travel along the length of the feed channel. The described benefits of nesting ink configurations that convey specific orientation or feed direction is a novel way to add additional functionality to the orientation shape objective.

Those skilled in the art will recognize that numerous modifications can be made to the specific implementations described above. Those skilled in the art will recognize that the interface elements may be formed into numerous shapes and configurations other than those illustrated. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an ink loader of an imaging device, the ink stick comprising:

an ink stick body configured for insertion into a feed channel of an ink loader of a phase change ink imaging device, the ink stick body having a leading end and a trailing end, the leading end being configured to precede the trailing end as the ink stick traverses the feed channel in a feed direction; and a visual feed direction indicator configured to point from the trailing end of the ink stick body towards the leading end.

2. The ink stick of claim 1, the visual feed direction indicator comprising an arrow-shape pointing from the trailing end toward the leading end of the ink stick body.

3. The ink stick of claim 2, the visual feed direction indicator being formed on at least one surface of the ink stick body.

4. The ink stick of claim 3, the visual feed direction indicator being formed on a surface extending between the leading end and the trailing end of the ink stick body.

5. The ink stick of claim 3, the visual orientation indicator being inset into the top surface of the ink stick.

6. The ink stick of claim 1, the ink stick body including a plurality of surfaces, the plurality of surfaces of the ink stick body defining a shape, the shape of the ink stick body comprising the visual feed direction indicator.

7. The ink stick of claim 6, the plurality of surfaces defining an arrow shape, the leading end of the ink stick body corresponding to a leading end of the arrow shape and the trailing end of the ink stick body corresponding to a trailing end of the arrow shape.

8. The ink stick of claim 7, the leading end and the trailing end being complementarily shaped.

9. A system of visual orientation conveyance to a user of a phase change ink imaging device, the system comprising:

a solid ink stick configured for insertion in an insertion orientation into an ink loader of a phase change ink imaging device, the solid ink stick including a visual orientation indicator incorporated into one or more surfaces of the ink stick, the visual orientation indicator comprising a mark for visually indicating the insertion orientation of the ink stick and being configured to point from a trailing end of the solid ink stick to a leading end of the solid ink stick; and a complementary orientation indicator on one or more surfaces of the imaging device, the complementary orientation indicator comprising a mark for visually indicating the insertion orientation of the ink stick.

10. The system of claim 9, the visual orientation indicator comprising an arrow-shape pointing from a trailing surface to a leading surface of the ink stick body.

11. The system of claim 10, the visual orientation indicator being formed on a surface extending between the leading end and the trailing end of the ink stick body.

12. The system of claim 11, the complementary orientation indicator comprising an arrow-shape mark positioned proximate an insertion opening and pointing in a feed direction of the imaging device.

13. An ink stick for use in an ink loader of a phase change ink imaging device, the ink stick comprising:

an ink stick body adapted to be received through an insertion opening of an ink loader of a phase change ink imaging device in an insertion orientation, the ink stick body including a leading end and a trailing end, the leading end being oriented to enter a feed channel in a feed direction of the ink loader when the ink stick body is in the insertion opening, and the trailing end being oriented to follow the leading end in the feed direction when the ink stick body is in the insertion opening;

a visual orientation indicator formed on at least one surface of the ink stick body, the visual orientation indicator for visually indicating a direction of orientation of the leading and trailing ends of the ink stick body to orient the ink stick body in the feed direction, the visual orientation indicator being configured to point from the trailing end of the ink stick body to the leading end of the ink stick body.

14. The ink stick of claim 13, the visual orientation indicator comprising an arrow-shape pointing from the trailing end to the leading end of the ink stick body.

15. The ink stick of claim 14, the visual orientation indicator being formed on a surface extending between the leading end and the trailing end of the ink stick body.

16. The ink stick of claim 15, the visual orientation indicator being inset into the top surface of the ink stick.

17. The ink stick of claim 16, the visual orientation indicator protruding from the top surface of the ink stick.

18. The ink stick of claim 13, the plurality of surfaces of the ink stick body defining a shape, the shape of the ink stick body comprising the visual orientation indicator.

19. The ink stick of claim 13, the visual orientation indicator having a shape similar to a complementary orientation indicator positioned on the imaging device.

* * * * *